US006905429B2

(12) United States Patent
Forsythe et al.

(10) Patent No.: US 6,905,429 B2
(45) Date of Patent: Jun. 14, 2005

(54) BASEBALL BAT WITH REPLACEABLE BARREL

(75) Inventors: Paul D. Forsythe, Phoenix, AZ (US); Douglas M. Hoon, Guilford, CT (US)

(73) Assignee: HoonForsythe Technologies LLC, Phoenix, AZ (US)

( * ) Notice: Subject to any disclaimer, the term of this patent is extended or adjusted under 35 U.S.C. 154(b) by 0 days.

(21) Appl. No.: 10/434,553

(22) Filed: May 8, 2003

(65) Prior Publication Data

US 2004/0224801 A1 Nov. 11, 2004

(51) Int. Cl.[7] ..... A63B 59/06
(52) U.S. Cl. ..... 473/566; 473/567
(58) Field of Search ..... 473/457, 519, 473/520, 564–568

(56) References Cited

U.S. PATENT DOCUMENTS

| | | | | | |
|---|---|---|---|---|---|
| 546,540 | A | | 9/1895 | Kennedy | |
| 1,509,733 | A | | 9/1924 | Langford | |
| 3,116,926 | A | * | 1/1964 | Owen et al. | 473/457 |
| 3,173,688 | A | | 3/1965 | Green | |
| 3,224,769 | A | | 12/1965 | Nickell | |
| 3,877,698 | A | | 4/1975 | Volpe | |
| 4,274,631 | A | | 6/1981 | Hayazaki | |
| 4,682,773 | A | | 7/1987 | Pomilia | |
| 4,720,104 | A | | 1/1988 | DiSieno | |
| 4,907,800 | A | | 3/1990 | Passamaneck et al. | |
| 5,114,144 | A | * | 5/1992 | Baum | 473/567 |
| 5,133,551 | A | | 7/1992 | Handy et al. | |
| 5,219,164 | A | * | 6/1993 | Peng | 473/520 |
| 5,277,421 | A | * | 1/1994 | Rewolinski | 473/457 |
| 5,360,209 | A | | 11/1994 | Mollica | |
| 5,409,214 | A | | 4/1995 | Cook | |
| 5,415,398 | A | | 5/1995 | Eggiman | |
| 5,590,875 | A | | 1/1997 | Young | |
| 5,676,609 | A | | 10/1997 | Mollebaek | |
| 5,820,438 | A | | 10/1998 | Horton, III | |
| 5,899,823 | A | | 5/1999 | Eggiman | |
| 5,954,602 | A | | 9/1999 | Eggiman et al. | |
| 6,050,908 | A | * | 4/2000 | Muhlhausen | 473/457 |
| 6,099,422 | A | | 8/2000 | Rappaport et al. | |
| 6,152,840 | A | | 11/2000 | Baum | |
| 6,251,034 | B1 | | 6/2001 | Eggiman et al. | |
| 6,383,101 | B2 | | 5/2002 | Eggiman et al. | |
| 6,398,675 | B1 | | 6/2002 | Eggiman et al. | |
| 6,406,387 | B1 | * | 6/2002 | Ryan | 473/457 |
| 6,432,006 | B1 | | 8/2002 | Tribble | |
| 6,443,860 | B1 | | 9/2002 | Byrne et al. | |
| 6,471,607 | B2 | | 10/2002 | Hsu | |
| 6,482,114 | B1 | | 11/2002 | Eggiman et al. | |
| 6,485,382 | B1 | * | 11/2002 | Chen | 473/566 |
| 6,497,631 | B1 | | 12/2002 | Fritzke et al. | |
| 6,511,392 | B1 | | 1/2003 | Chohan | |
| 2002/0055402 | A1 | * | 5/2002 | Ciesar et al. | 473/457 |
| 2002/0072436 | A1 | * | 6/2002 | Liu | 473/457 |
| 2003/0069095 | A1 | * | 4/2003 | Turos | 473/457 |
| 2003/0114257 | A1 | * | 6/2003 | Mabry | 473/457 |

* cited by examiner

*Primary Examiner*—Mark S. Graham
(74) *Attorney, Agent, or Firm*—Schmeiser, Olsen & Watts LLP

(57) ABSTRACT

A baseball or softball bat configured to allow the removal and replacement of the barrel section of the bat if the barrel is damaged or simply for enabling selection of a barrel having particular performance characteristics. Alternatively, the barrel may be selectively changed to meet certain regulation requirements. In one aspect, one or more components of the ball bat can be provided as a kit. In another aspect, the ball bat can be made by forming and assembling the components simply and inexpensively. Exemplary embodiments include a center tube or handle, a transition, and a barrel some or all of which can be separably combined during assembly.

15 Claims, 8 Drawing Sheets

BASEBALL BAT WITH REPLACEABLE BARREL

BACKGROUND OF THE INVENTION

1. Technical Field

This invention generally relates to baseball and softball bats and, more particularly, to reconfigurable bats that allow for the replacement of the barrel should a different level of performance be desired or should the barrel become damaged.

2. Background Art

The disclosures and inventions of the past are deficient in teaching the use of a bat with a barrel section that may be removed from the bat and replaced with a new section when a change in the performance characteristics of the bat is required or when the barrel section becomes damaged. Rather, the approaches of the past address the issues of performance and durability by trading-off one against the other in an attempt to achieve a balance which the user might appreciate.

On the contrary, the designers of baseball and softball bats have had as a primary object, a bat that can hit a ball long distances. Designers have as a secondary object a bat which is durable and can survive repeated impacts with the ball. It is difficult to accomplish one of these objectives without compromising the other.

The characteristics of a bat are very largely determined by the types of materials and the geometry of the components including a thickness of the barrel section of the bat. Depending upon the performance and/or durability desired, the bat may be very durable or easily susceptible to damage during play. Likewise, its performance, measured by the batted ball speed, may be high or low. Most high performance bats manufactured today are hollow. They rely upon the deformation of the barrel wall, principally in the hoop mode, to provide a so-called "trampoline effect" which leads to higher batted ball speeds. Bats of this construction can be as much as 50% more efficient than solid wood bats. That is, the batted ball speed can be as much as 50% higher for hollow bats than for wooden bats. Because such high performance gives an advantage to the batter, most players prefer to use a bat with as high a performance rating as possible. Higher batted ball speeds, however, put the pitcher and other infielders at some risk of being struck by a ball traveling so rapidly that they have insufficient time to react. To protect players in the infield, bat performance is generally regulated. To be competitive, bats must perform at or near these regulated limits. However, even to achieve these regulated limits, barrel walls must generally be thinned to the point that durability becomes an important issue. It is common, among the highest performing population of bats, especially in the hands of good athletes, for these bats to be damaged within 50–500 impacts. This damage renders the bats of the past unsuitable for further use.

The first bats ever produced were made from solid wood and were of one piece construction. This design endured without significant change for about ¾ of a century until hollow aluminum bats were introduced. These aluminum bats and subsequent composite bats have followed the original wooden bats in form except for their hollow construction. Designers have continued to struggle with the tradeoff between performance and durability. Their solutions have been deficient in many regards.

Numerous solutions have been proposed for improving durability, all with varying degrees of success. In each case, efforts to improve the durability of the bat generally result in a reduction in performance. The liveliness of the bat, principally resulting from the so-called "trampoline effect" is closely tied to the stiffness of the barrel section of the bat. To some degree, reducing stiffness increases trampoline effect and vice-versa. Increasing thickness of the barrel wall quickly increases the bending stiffness of the wall, allowing the wall to deform less, and reducing the trampoline effect as a result. Another shortcoming resulting from these approaches is an increase in the bat's weight and its polar moment of inertia, both making the bat more difficult to swing rapidly and decreasing the batter's ability to hit the ball well.

DISCLOSURE OF THE INVENTION

The present invention relates to a baseball or softball bat that is provided with a means to quickly and easily remove and replace the barrel section of the bat by one of a variety of different barrel sections configured for different levels of performance and durability depending upon the batter's level of play and the rules of the game in which the bat is being used. This aspect of the invention also allows replacement of the barrel section whenever it has become damaged, whether through contact with the ball as occurs in the normal course of play, or otherwise.

The invention includes the idea of accepting limited durability in exchange for higher performance without investing in a bat that is prone to irreparable failure. The practical application of this idea enables an end user to easily and affordably choose between more or less performance and more or less durability as the situation demands. In case of failure of a particular barrel section, the barrel section can simply be replaced without the loss of the complete bat. Specifically, the invention enables a batter to modify the performance level of a bat, either to a higher or a lower level, based upon his or her ability level and based upon the rules of the game as imposed by local or national rules making bodies. In fact, a bat can be modified to enable its use in both softball and baseball.

Furthermore, a bat of the present invention can be modified for several levels of play. For example, a first highest level may be defined in terms of the intended function of hitting the ball as far as possible, or a home run level. A second intermediate level of performance may be defined by its intended function of enabling a hitter to make a base hit. A barrel having characteristics for this intermediate level of performance may be useful for cases in which the maximum number of home runs has been achieved in a given game, and a reduced performance is desired to avoid additional home runs. A third lower level of performance for a practice or swing bat has even lower performance, but is much more durable. A fourth level of performance is specifically configured to be more durable in cold weather conditions. Thus, there is disclosed herein means for quickly and easily replacing a barrel section of a softball or baseball bat to selectively modify a performance level of the bat.

The invention also includes enabling these modifications to be made quickly, by the bat owner, without need to return the bat to a manufacturer, dealer, or other third party. Related to this feature, the components can be of low complexity that can be easily manufactured in mass or lots so that the components can be kept in stock to be readily available. Alternatively, extras can be kept by the user. Thus, replacement of the components including the barrel section to return a bat to a state of playability is easy and inexpensive.

An example of a bat that implements the invention accordingly in a simple form is a reconfigurable ball bat having a center tube with a first diameter and a first length extending between a proximal end and a distal end of the center tube. The bat further includes a transition piece mounted on the center tube at a position spaced from the proximal end of the center tube. The minimum diameter of the transition piece bearing surface is greater than or equal to approximately twice the first diameter. In one aspect, the transition piece has a bearing surface with a minimum diameter in the range from 2 to 3½ times the first diameter. The bat also has a barrel with a proximal end including a proximal bearing surface. The proximal bearing surface has a minimum diameter greater than or equal to approximately twice the first diameter. In one aspect, the proximal bearing surface has a minimum diameter in the range from 2 to 3½ times the first diameter. In the assembled state, the proximal bearing surface of the barrel is solely in contact with the bearing surface of the transition piece so that structural contact only occurs at a diameter equal to or greater than approximately twice the first diameter. In one aspect, the structural contact between the barrel and the transition only occurs at a diameter in the range from 2 to 3½ times the first diameter.

In one aspect of the invention, structural components that hold the barrel on the transition piece can include the center tube being connected to the end cap. One way this can be achieved is by connecting an end plug to a distal end of the center tube. An end cap is also provided and abutted with a distal end of the barrel. An assembly screw engages in the end plug and holds the end cap on the distal end of the barrel. In this way, the end cap provides a coupler at a distal end of the barrel. Thus, the coupler removably mounts the barrel on the transition piece.

In another aspect of the invention, the coupler is one of a plurality of couplers. Some of these couplers can be interchanged on a given bat. The couplers can have minimum diameters in the range from approximately 2 to approximately 3½ times the diameter of the center tube so that a coupler can be selected to accommodate a selected barrel. This aspect of the invention highlights the reconfigurability of the bats of the invention. This reconfigurability lends itself to another aspect of the invention, which is that one or more component of a bat can be packaged or provided as a kit.

While the kit may include as few as one component, typically the kit would include more than one component including assembly instructions. For first time purchases, the kit would normally include a complete ball bat. In this case, the reconfigurable ball bat kit would include a center tube, at least one transition piece, and at least one barrel. This kit may have the barrel selectively connectable and separable from the center tube. The kit may further include a plurality of barrels that are selectively supported on the center tube by the transition piece.

Another aspect of the invention is a method of using the reconfigurable ball bat. This method entails selecting a component to replace an existing component on the reconfigurable bat. As such, the invention more specifically includes selecting a replacement barrel to replace an existing barrel. The replacement barrel is supported on the center tube by at least one transition. Added advantages are further provided when the replacement barrel is selected from among a plurality of barrels.

In another aspect, the invention includes a method of making a ball bat. This method includes forming a center tube to have a first inner diameter and a first outer diameter. Making the ball bat also includes forming a transition piece with an outer surface including a barrel abutting bearing surface and an opening having an inner surface. A dimension of the inner surface matingly receives the first outer diameter of the center tube. Another step in the method of making is forming a barrel having a second outer diameter and a second inner diameter. The second inner diameter is made to match the barrel abutting bearing surface on the outer surface of the transition piece so that the barrel fits on the barrel abutting bearing surface. The various components of the ball bat are assembled by connecting the transition piece to the center tube and the barrel to the barrel abutting bearing surface of the transition piece.

In one aspect of the method of making, the step of connecting the barrel to the transition piece is facilitated by providing an end cap for the ball bat. The end cap is connected to a distal end of the barrel. The end cap supports the barrel on the transition by also being connected to the center tube. To this end, an end plug is formed and connected to a distal end of the center tube. An assembly screw or nut is provided and used for connecting the end cap to the barrel by engaging the screw or nut with the end plug. Alternatively stated, connecting the barrel to the transition piece can be accomplished by abutting a proximal end of the barrel with the barrel abutting bearing surface of the transition piece, abutting the end cap with the distal end of the barrel, and clamping the barrel between the transition piece and the end cap. The clamping action is effected by engaging the assembly screw or nut with the end plug and turning the assembly screw or nut.

It is to be understood that in all aspects of the invention set forth above, the barrel is removably mounted to the transition piece by structure that can be manipulated by hand or with a tool so that the barrel can be removed and replaced quickly and easily. In another aspect, the invention has structure on one or more of the center tube, transition piece, and the barrel enabling simple manipulation so that the kit can be assembled and disassembled quickly and easily in a dugout or on the field for example.

In another aspect the invention includes a reconfigurable ball bat in a range of standard sizes for baseball and softball. This ball bat includes a handle portion, a barrel section removably connected to the handle portion, and a butt end supported on the barrel. This bat, assembled with a knob supported on the handle portion, has a length within the range of standard sizes for ball bats. Furthermore, the bat meets all the standards for ball bats established by at least one recognized official regulating organization such as the NCAA or ASA, for example. These standards commonly include a weight requirement in ounces equal to the length of the bat in inches minus at least three. In this aspect, the reconfigurable ball bat has all the couplers and structural elements to securely hold the various components together. Yet the reconfigurable ball bat can weigh less than or equal to 30 ounces, which is approximately the practical upper weight limit for competitive standard bats. In some configurations the bat weighs less than or equal to 28 or 26 ounces respectively. In still further configurations, the ball bat weighs in a range from 22 to 24 ounces. These advantageous characteristics are provided in part by incorporating light weight materials in the bats of the present invention as will be further described below.

To provide reassurance that the bats of the present invention meet and will continue to meet the established regulations of a given organization, the bats of the present invention include at least one of the handle portion, a barrel section, and a butt end that is removably connected to the rest of the bat so that the bat can be easily and quickly taken apart for inspection and put back together on the field.

Furthermore, the invention in any of its forms can include a tamper resistant element for connection to the center tube or to the barrel section. The tamper resistant element inhibits tampering with the center tube or barrel without obvious modification to the tamper resistant element. Thus, if a user attempts to modify the bat by adding or removing material from the center tube or barrel section, a noticeable modification of the tamper resistant element will occur. An official may take the bat apart and inspect it to detect any such tampering.

It is contemplated that the tamper resistant element may be an enclosing seal covering otherwise open ends of a barrel, for example. Alternatively, the tamper resistant element may be configured as a tube or sleeve surrounding a center tube, or covering an inner surface of a barrel section. Typically, this tamper resistant element will be flexible, and generally will not contribute substantially to the structural strength of the bat. However, it is contemplated that the tamper resistant element may provide an advantageous function of selectively adding a predetermined amount of weight at a predetermined location. For example, a tubular sleeve of a predetermined thickness and weight could extend along the center tube as a protective layer and a weight adding ballast.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a reconfigurable bat. Throughout the remainder of the description, the bats of each of the embodiments are described with the end of the bat that is normally held by the user during play defined as the proximal end, and the end closer to where the ball normally strikes the bat defined as the distal end.

Figure 1:
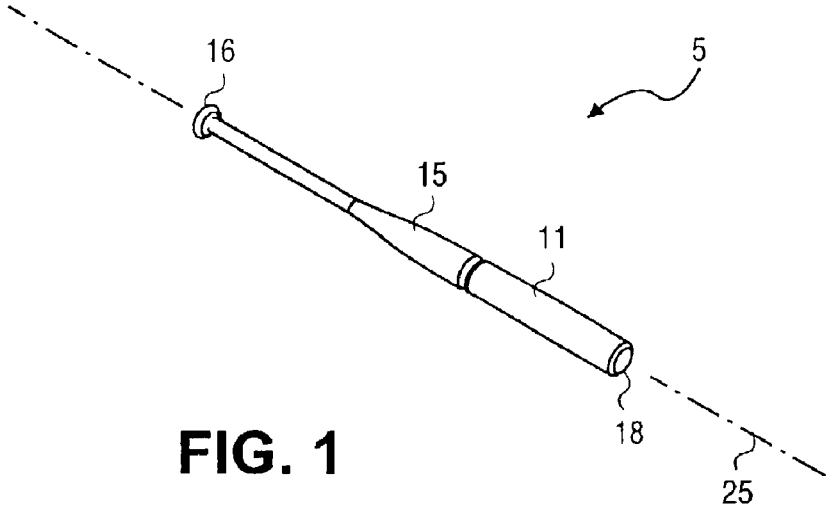
FIG. 1 is a perspective view of a bat in accordance with a first embodiment of the invention comprising an integral handle and transition section and an attached barrel section.
Figure 2:
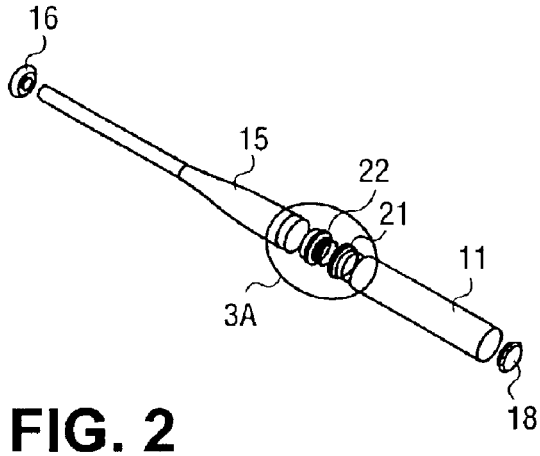
FIG. 2 is an exploded perspective view of the bat of FIG. 1.

FIG. 1 is a perspective view of a first embodiment of a bat 5 with a removable barrel 11 consisting of an integral handle and transition 15 and a barrel 11 joined together with a pair of threaded fittings (21 and 22) as shown in the exploded view of FIG. 2. The bat 5 is closed on a proximal end with a knob 16 and on the distal end with a solid end cap 18. The bat 5 is a hollow bat that behaves similarly to existing aluminum and composite bats with the exception that the barrel 11 may be separated from the integral handle and transition 15 simply by unscrewing one from the other. The knob 16 is permanently attached to the integral handle and transition 15. This can be achieved either by welding or gluing. Alternatively, the knob 16 is integrally molded with the handle 14 during manufacture. Similarly, the solid end cap 18, can be permanently attached to the barrel 11.

The barrel 11 is comprised of a hollow cylinder fabricated from metal such as aluminum or fiber reinforced composites such as graphite fiber, fiberglass or aramid fibers in a polymer matrix such as epoxy, thermoset, or thermoplastic resins. It may also be fabricated from wood if a lower performance bat is desired. The barrel 11 ranges in length from about 7 inches to about 14 inches and ranges in thickness from about 1/20 inch to about 1/4 inch, depending on the material of construction. The diameter of the barrel 11 may be of any size, but typically will range in size from about 2 1/4 inches to about 2 3/4 inches. The ends of the barrel are normal to a central axis 25. On one end of the barrel 11, an aluminum threaded sleeve 21 is attached via adhesive bonding and/or rivets to firmly secure the sleeve 21 to the barrel 11. The sleeve 21 is preferably a threaded female fitting. To the other end of the barrel 11, a solid end cap 18 is attached via adhesive bonding to firmly secure these two pieces together.

The integral handle and transition 15 is a hollow section made from aluminum or fiber reinforced composites such as graphite fiber, fiberglass or aramid fibers in a polymer matrix such as epoxy, thermoset, or thermoplastic resins. To a distal end of the integral handle and transition 15, as shown in FIG. 2, an aluminum male threaded flange fitting 22 is attached via welding or adhesive bonding and/or rivets to firmly secure the flange fitting 22 to the handle and transition piece 15. To the opposite end of the integral handle and transition 15, a knob 16 is mechanically attached via welding or a pinned and adhesive joint. Alternatively, the knob 16 can be co-molded with the handle and transition 15 if it is made from plastics or composites. In any case, the barrel 11, the sleeve 21, and the end cap 18 form a barrel assembly of a first permanently joined group of parts. Similarly, the handle and transition 15, the knob 16, and the flange fitting 22 form an integral handle and transition assembly of a second permanently joined group of parts.

The resulting two-piece bat 5 functions similarly to existing one-piece bats until such time as the barrel 11 is damaged or the batter chooses to replace it by changing the barrel 11 to a barrel of differing performance characteristics better suited to the current game. At that time, a barrel assembly is unscrewed from an integral handle and transition assembly and a new barrel assembly is screwed into place.

Figure 3A:
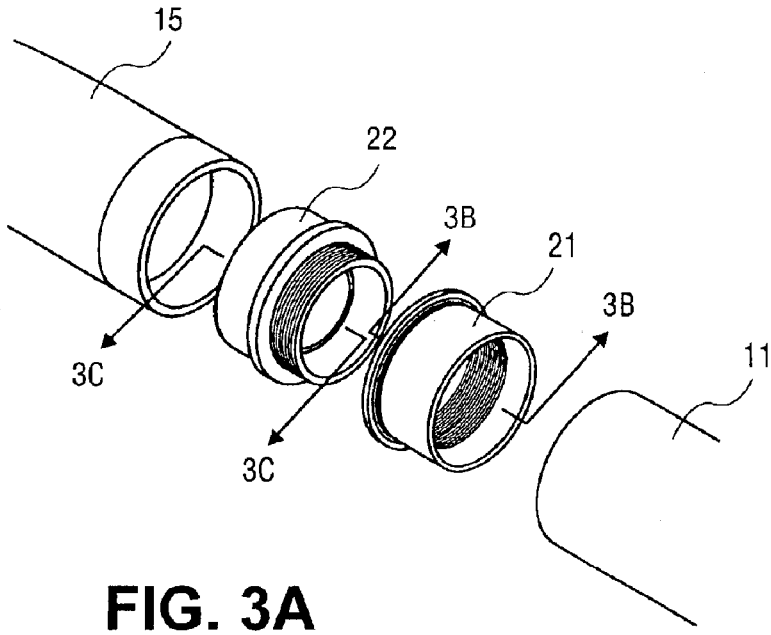
FIG. 3A is an exploded perspective view of a region 3A of FIG. 2 showing a pair of fittings used to connect the bat handle and barrel of FIGS. 1 and 2.

FIG. 3A is a more detailed exploded perspective view of a region 3A of FIG. 2. The fittings 21, 22 and respective portions of the bat 5 to which the fittings 21, 22 are connected are shown. In this figure the geometry of the threaded fittings 21, 22 is better shown. These drawings depict representative configurations for both parts and are not meant to be restrictive so long as the function of joining the two principle sections of the bat is maintained. Also shown more clearly are the surfaces which may be bonded or otherwise attached to the inside diameters of the integral handle and transition 15 and the barrel 11.

Figure 3B:
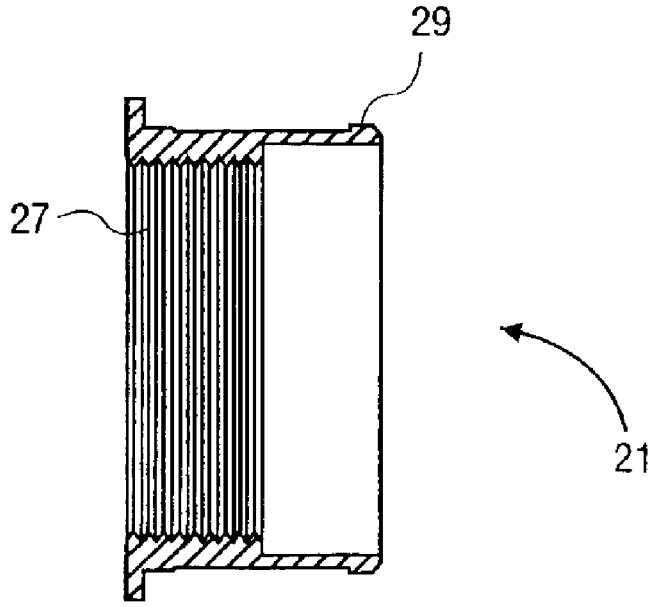
FIG. 3B is a sectional view taken along lines 3B—3B of FIG. 3A.
Figure 3C:
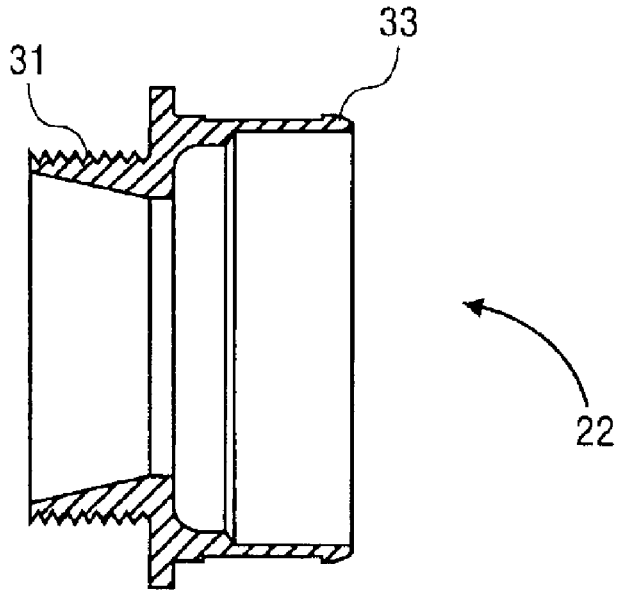
FIG. 3C is a sectional view taken along lines 3C—3C of FIG. 3A.

FIGS. 3B and 3C are sectional views taken along lines 3B—3B and 3C—3C of FIG. 3A respectively. The sleeve fitting 21 has female threads 27 and a radially protruding rib 29 extending outwardly from a sleeve portion of the fitting 21 as shown in FIG. 3B. The male threaded fitting 22 has male threads 31 and a radially extending rib 33 extending outwardly from a sleeve portion of the fitting 22. The radially extending ribs 29, 33 can provide a snap lock attachment to the handle and transition 15 and to the barrel section 11 to compliment rivets or adhesives.

Figure 4:
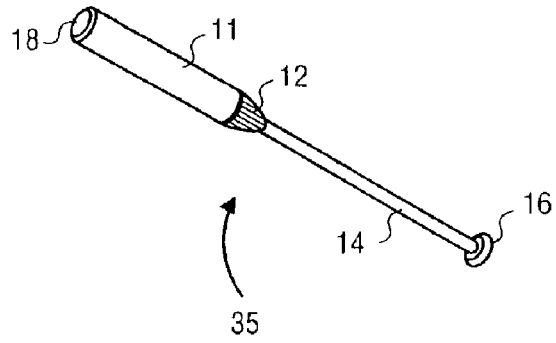
FIG. 4 is a perspective view of a bat in accordance with a second embodiment of the invention comprising a central tube or handle, a mounted transition section, and an attached barrel section.

FIG. 4 is a perspective view of a second embodiment of a bat 35 utilizing the barrel 11 described in the embodiment of FIGS. 1–3C above. The bat 35 includes a center tube or handle 14 and a transition 12 that are different from those provided by the integral handle and transition 15. The bat 35 also includes the threaded sleeve 21, the barrel 11, the solid end cap 18, and the knob 16 similar to those described above. In this embodiment the transition 12 includes an integral male threaded flange 37 that mates with the threaded sleeve 21 to form the joint between handle 14 and barrel 11. This joint allows the barrel 11 to be easily removed and replaced by the owner. As in the previous embodiment shown in FIGS. 1–3C, the knob 16 and solid end cap 18 are permanently attached to the handle 14 and the barrel 11 respectively.

The handle 14 is preferably a hollow tube made from a metal such as aluminum or a fiber reinforced composite material such as graphite, fiberglass or aramid fibers in an epoxy, thermoset, or thermoplastic matrix. The handle 14 could alternatively be solid and formed of the above stated materials or wood. The thickness of the hollow version of handle 14 ranges from about 1/20 inch to 1/4 inch, depending upon the type of material and the allowable weight and depending upon the structural loads to be encountered during play. The outside diameter of the handle 14 ranges from about 3/4 inch to about 9/10 inch. The length of the handle 14 depends upon the chosen length of the barrel 11, knob 16, solid end cap 18, and the overall length of the bat selected. The transition 12 fitting is attached by welding or adhesive bonding and/or rivets to a distal end of the handle 14 in order to firmly secure the transition 12 to the handle 14. To the opposite end of the handle 14, the knob 16 is mechanically attached via welding or a pinned and adhesive joint. Alternatively, the knob 16 can be co-molded with the handle 14 if the handle 14 is made from plastics or composites.

Figure 5:
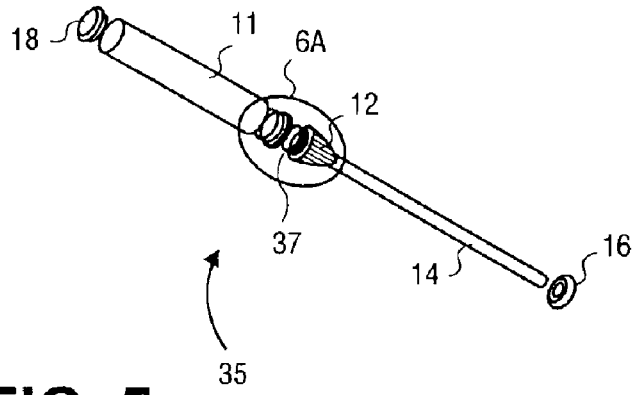
FIG. 5 is an exploded perspective view of the bat of FIG. 4.

FIG. 5 is a perspective exploded view of the bat shown in FIG. 4. FIG. 5 shows the relative locations of the fitting and threaded flange various elements more clearly.

Figure 6A:
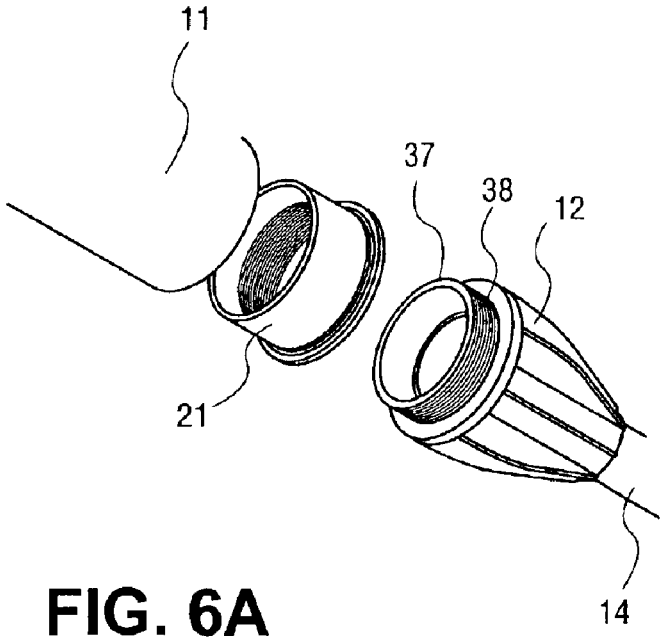
FIG. 6A is an more detailed exploded perspective view of a set of fittings used to connect the barrel and the handle of the bat of FIGS. 4 and 5.

FIG. 6A is a more detailed exploded perspective view of region 6A of the bat 35 shown in FIG. 5. In this figure the geometry of the threaded sleeve 21 and the transition 12 are shown. These drawings depict representative configurations for both parts and are not meant to be restrictive so long as the function of joining the two principle sections of the bat is maintained. Also shown more clearly are the surfaces which may be bonded or otherwise attached together to join the inside diameter of the barrel 11 and the outside diameter of the threaded sleeve 21. As can be appreciated, the treaded sleeve 21 is configured to receive a larger diameter end of the transition 12.

The transition 12 is configured to increase the outer diameter of the bat from the diameter used to make the handle 14 to the diameter of the barrel 11. The length of the transition 12 section is variable, based on a desired weight and appearance. Preferably, the transition 12 is fabricated completely or in part from metal such as aluminum so that integral threads 38 are provided with good load transfer capability as can be appreciated from FIG. 6A.

Figure 6B:
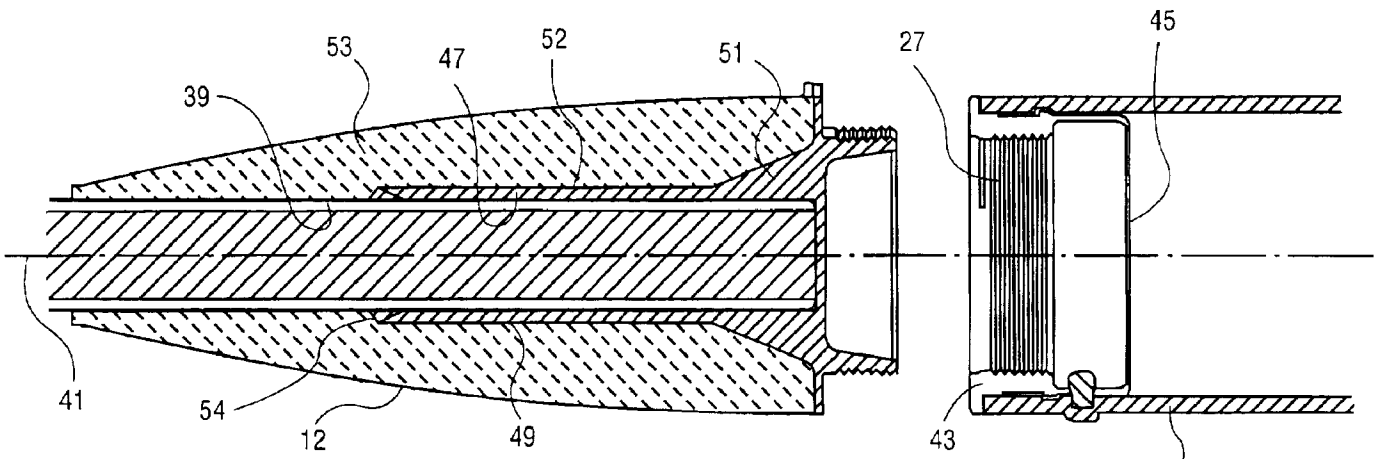
FIG. 6B is a sectional side view of the variation of the fittings of FIG. 6A in a partially assembled state.

FIG. 6B is a sectional view of the same region of the bat 35 as shown in FIG. 6A with an alternative threaded sleeve 43 installed in the barrel 11. The alternative threaded sleeve 43 has a web 45 that spans the barrel in a radial direction and acts as a tamper resistant seal. The web 45 is preferably a thin film in the range from approximately 1/100 to approximately 3/100 inch. (That is, in the range from approximately 10 to 30 thousandths of an inch in thickness.) This web or film 43 forms a seal that provides a way of detecting whether an interior of the barrel has been accessed for illegal machining or material removal. If, during inspection, the seal is found to be broken, then the bat would be suspect.

In the transition itself, a hole defining an inner surface 39 having a first diameter extending along a central axis 41 of the transition 12 is sized to closely fit to the handle 14 as shown in FIG. 6B. If the handle 14 is made from similar material as the transition 12, e.g., aluminum, the transition 12 can be welded to the handle 14 at a proximal end of the transition 12. If the handle 14 is made from composites, the transition can be bonded with an adhesive and/or pinned to the handle 14 to form a good structural joint.

A small step increase in the diameter of the handle 14 and a corresponding step increase in the diameter of the inner surface 39 of the transition 12 to a second diameter 47, which is larger than the first diameter 39, is incorporated into the bat 35 in order to positively prevent the transition 12 from sliding distally toward the barrel 11 when the bat is swung. As indicated by a line 49, this step in diameter can be accomplished by a male threaded flange piece 51 that has an integral sleeve 52 that forms the step and has a diameter that matches the second diameter 47. During manufacture, the threaded male flange piece 51 can be mounted to the handle 14 prior to the remainder 53 of the transition 12. To facilitate mounting and adhering the flange piece 51 to the handle 14, the sleeve 52 is provided with a chamfer 54. This chamfer aids in receiving and spreading an adhesive between the sleeve 52 and the handle 14. The male threaded flange piece 51 actually forms part of the transition 12 and is preferably formed of a metal such as aluminum. The remainder 53 of the transition could be made integral with the sleeve 52 and formed from metal, but doing so is generally cost prohibitive. Thus, the remainder 53 of the transition 12 is preferably formed of a plastic or composite material having a sleeve of its own that surrounds sleeve 52. As such, the remainder 53 of the transition 12 can be slid over a proximal end of the handle 14 to surround and abut the male threaded flange piece 51 during assembly.

Figure 7A:
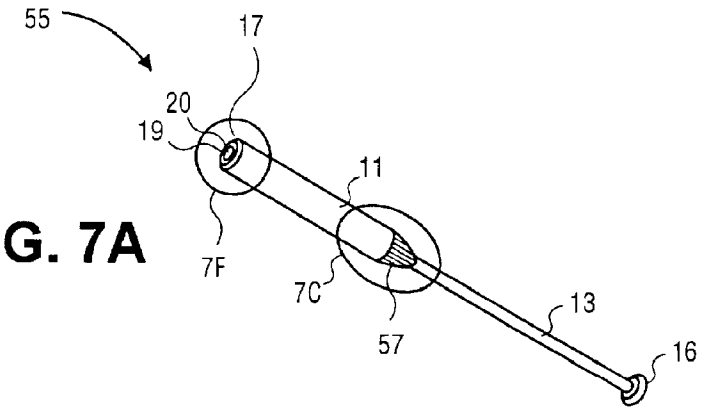
FIG. 7A is a perspective view of a bat in accordance with a third embodiment of the invention comprising a long central tube, an attached transition section and a barrel clamped between the transition section and a hollow end cap.

FIG. 7A is a perspective view of the third embodiment of a reconfigurable bat 55 with a removable barrel 11 and a knob 16 similar to the barrels and knobs described for the embodiments of FIGS. 1–6B above. The bat 55 also has structurally different parts including a central tube 13, a transition 57, a hollow end cap 17, a threaded plug 20, and a nut 19. In this embodiment the joint between the transition 57 and the barrel 11 is unthreaded. Furthermore, the joint between the barrel 11 and the hollow end cap 17 is not permanent. The joining of the various parts of the bat in this embodiment is accomplished by assembling all of the components onto the central tube 13, including a nut 19 which screws onto the threaded plug 20 to secure the assembly together.

The central tube 13 is a structural element made from a metal such as aluminum, a fiber reinforced composite materials such as graphite, fiberglass or aramid fibers in an epoxy, thermoset, or thermoplastic matrix similar to the central tube or handle 14 described with regard to the embodiment of FIGS. 4–6B above only longer. In fact, the central tube 13 extends substantially completely through the barrel to the distal end of the bat 55. The length of the central tube 13 depends primarily upon the overall length of the bat selected, with small adjustments in its length made for the length of the threaded plug 20 and the knob 16. The central tube 13 could also be provided as a solid rod of the same or other materials, including wood.

Approximately midway along the central tube 13, a transition 57 is preferably removably attached. Alternatively, the transition 57 can be attached via welding or adhesive bonding and/or rivets to firmly secure the transition 57 to the central tube 13. To the proximal end of the central tube 13, the knob 16 is mechanically attached as set forth in the description of the other embodiments above. To the distal end of the central tube 13 is welded or bonded and/or pinned a threaded plug 20 as can be appreciated from the exploded perspective view of FIG. 7B.

Figure 7B:
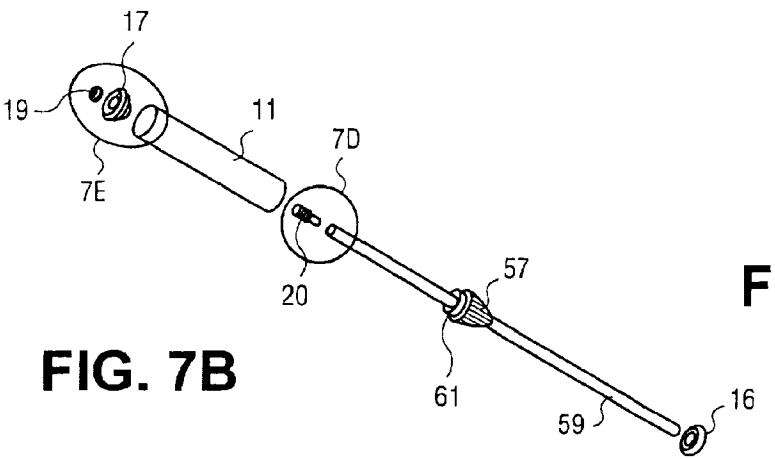
FIG. 7B is an exploded perspective view of the bat of FIG. 7A.

FIG. 7B better shows the various components of the bat in their relative assembly positions. Specifically, FIG. 7B shows the threaded plug 20, the nut 19, the hollow end cap 17, and the central location of the transition 57. The threaded plug 20 is for clamping the end cap 17 onto the end of the barrel 11 to hold the barrel against the transition in an assembled position.

As in the previously described embodiments, the transition 57 is configured to increase the outer diameter of the bat from that of the central tube 13 including a handle portion 59 to the diameter of the barrel 11. The length of the transition 57 is variable, based on desired weight and appearance. In this embodiment, the transition 57 may be fabricated from metal such as aluminum, an injection molded engineering thermoplastic, thermoset material, or other material since integral threads are not required. The hole through the transition 57, along the central axis of the transition 57, is sized to closely fit to the center tube 13. Preferably the transition 57 is removably mounted on the center tube 13 so that the transitions 57 of different configurations can be used. However, if the center tube 13 and the transition 57 are both made from the same metal, e.g., aluminum, the two can be welded together at a proximal end of the transition 57. If the center tube 13 is made from composites, the two may be bonded together with an adhesive and/or pinned together to form a good structural joint.

Figure 7C:
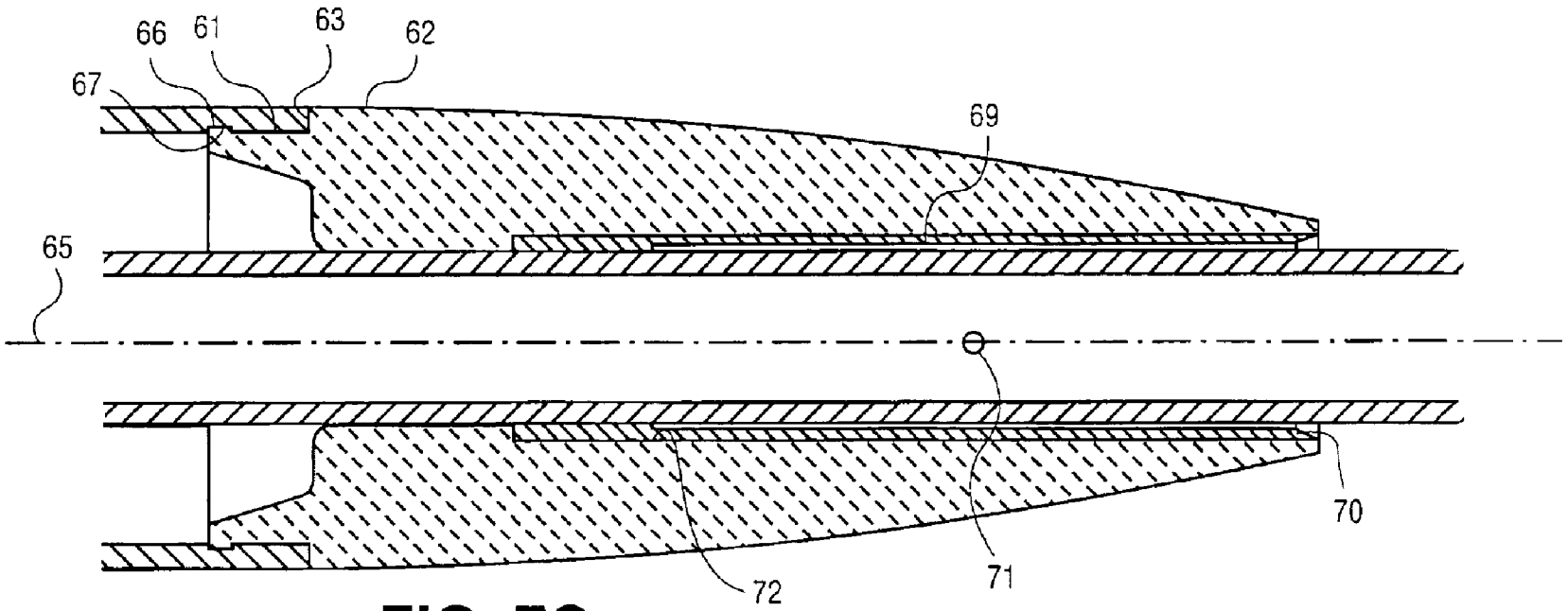
FIG. 7C is a sectional side view of a transition piece and barrel interface of the bat of FIG. 7A.
Figure 7D:
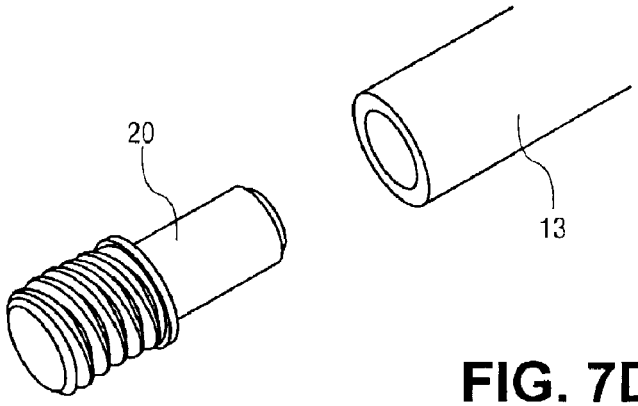
FIG. 7D is an exploded perspective view of a threaded plug fitting and the central tube used in the bat of FIGS. 7A and 7B.
Figure 7E:
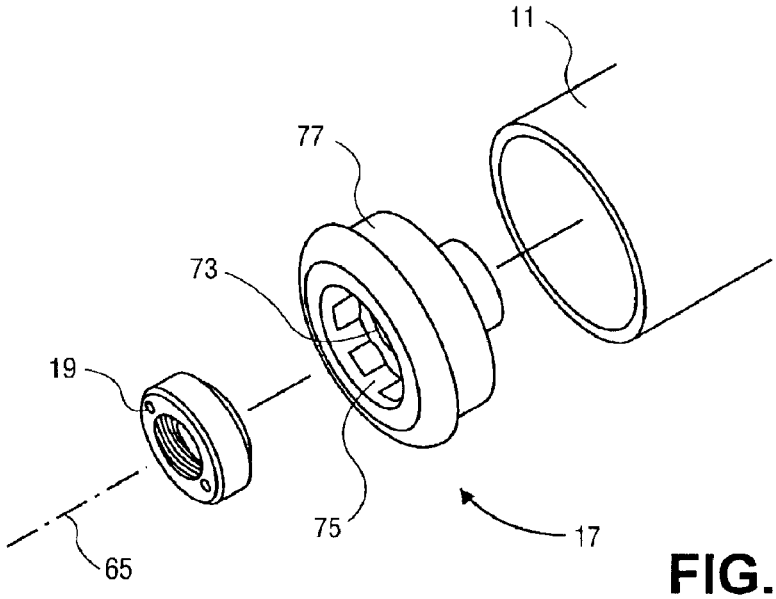
FIG. 7E is an exploded perspective view of a hollow end cap, a nut, and the barrel used in the bat of FIGS. 7A and 7B.
Figure 7F:
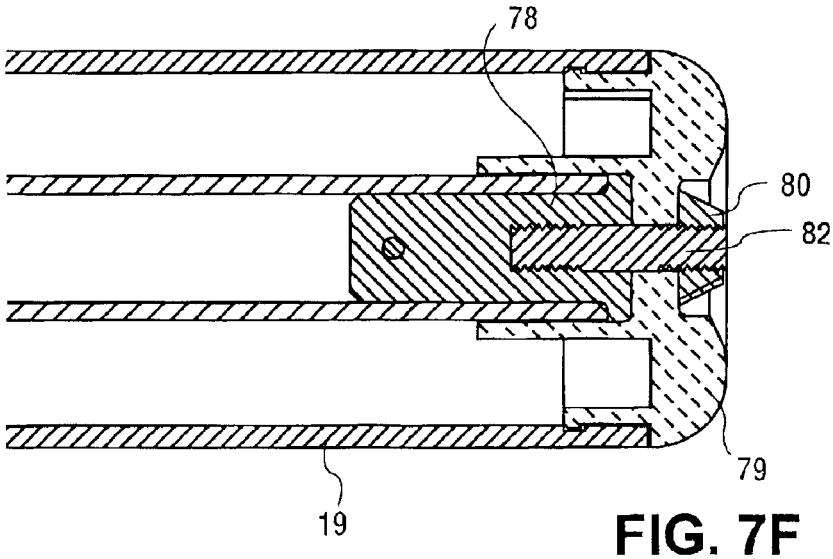
FIG. 7F is a sectional side view of a variation of the end plug, end cap, and nut in accordance with the embodiment of FIGS. 7A and 7B.
Figure 8A:
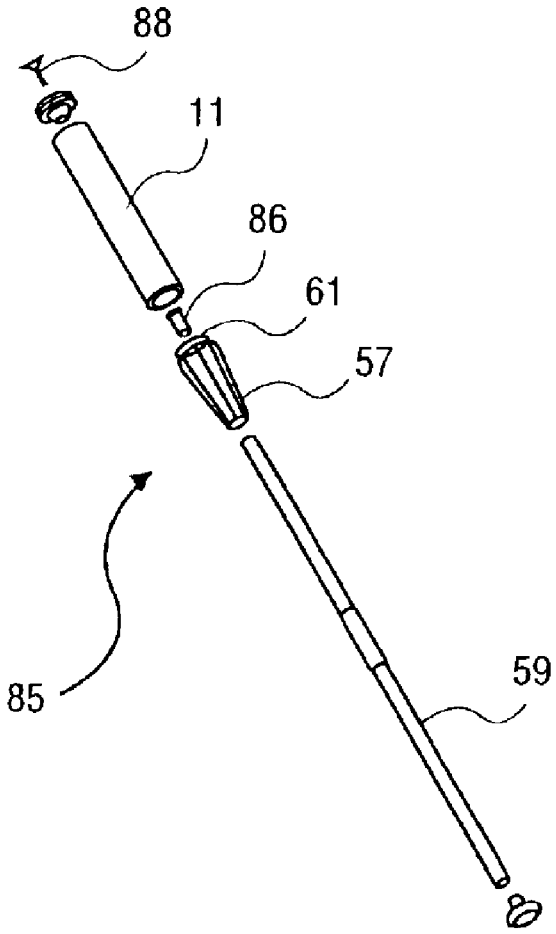
FIG. 8A is an exploded perspective view of a bat in accordance with a fourth embodiment of the invention.
Figure 8B:
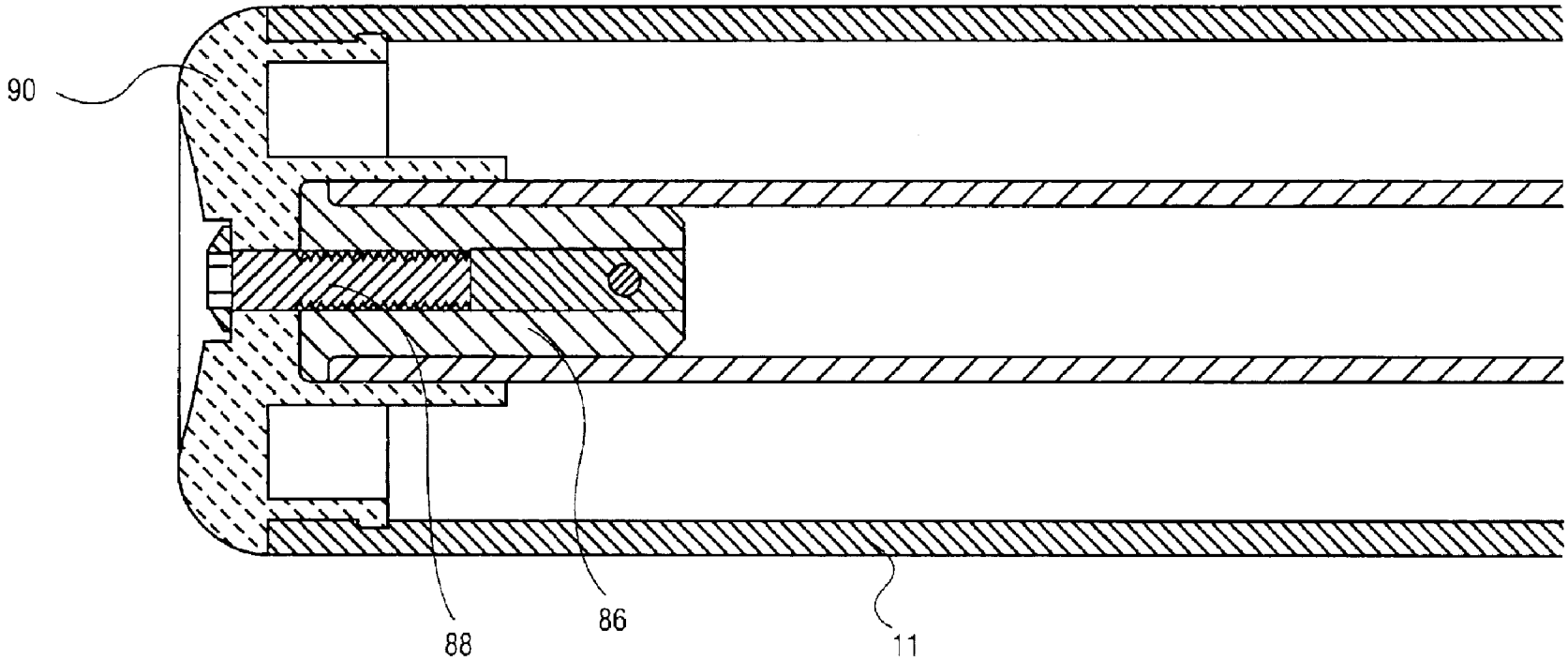
FIG. 8B is a sectional side view of the bat of FIG. 8A showing the configurations of an end plug, an end cap, and a screw in an assembled state.

In the embodiments of FIGS. 7–8B, a smooth flange 61 of the transition 57 mates with the barrel 11. The smooth flange 61 is not threaded, but presents a smooth surface which slides into and supports the barrel 11 as shown in FIGS. 7B and 7C. The flange 61 itself is slightly recessed radially from an outermost surface 62 of the transition 57. This recess allows an end of the barrel 11 to squarely mate with a surface 63 of the transition 57 extending radially outwardly from the flange 61 at the joint between the flange 61 and the remainder of the body of the transition 57. The radially extending surface 63 is normal to a central axis 65 extending along the length of the central tube 13.

FIG. 7C is a sectional side view of the bat 55 of FIG. 7A showing how the barrel 11 and transition 57 fit together. As shown, an inner surface of the barrel 11 can be provided with an annular depression 66 and the smooth flange 61 can be provided with a corresponding annular protrusion 67 for snap-fitting into the depression 66.

In the embodiments of FIGS. 7A–8B, a small step change in the diameter of the central tube 13 and a corresponding diameter change in the central hole of the transition 57 may be included in the structure as best shown in the cross sectional view of FIG. 7C. This step change in the outer diameter of the central tube 13 is provided by adding a wrap or sleeve 69 to the central tube 13. The wrap or sleeve 69 is permanently bonded to the central tube 13. The wrap 69 can be adhesively bonded to the center tube 13. This may be accomplished by a separate adhesive material applied between the wrap and the center tube 13. Alternatively, adhesive bonding may be provided by the nature of the material from which the wrap is formed. That is, the wrap may be formed of a fibrous material that is pre-impregnated with a resin which may also include additional fibrous materials. Such a wrap can be adhered by applying a heat treatment to catalyze a reaction between the fibers and the resinous material. At the same time, the resinous material forms a bond with the center tube 13 and bonds the wrap thereto. The wrap or sleeve material is selected based on its compatibility with the material of the center tube 13 and a relative ease of assembly desired for manufacturing purposes. Preferably, the sleeve 69 is an aluminum sleeve that is adhesively bonded to the center tube 13. As described above, a chamfer 70 is provided to aid in receiving and distributing an adhesive between the sleeve 69 and the center tube 57. Additionally or alternatively a retention pin 71 can be used to secure the sleeve 69 to the center tube 57. A step 72 in the inner surface of the transition 57 is formed by providing the inner surface with a larger diameter to match that of the wrap or sleeve 69. The steps in both of the outer diameter of the central tube 13 and the inner surface of the transition 57 are provided to positively prevent the transition from sliding in a proximal direction toward the knob 16 when the nut 19 is tightened onto the threaded plug 20, for example.

FIG. 7D is a more detailed view of a region 7D of FIG. 7B showing the threaded end plug 20 and the distal end of the center tube 13, which are permanently connected during assembly as described above. In this figure the geometry of the threaded plug 20 and the central tube 13 are shown. Also shown more clearly are the surfaces which may be bonded or otherwise attached together to join the inside diameter of the central tube 13 and the smooth outside diameter of the threaded plug 20. This joint provides a structurally stable connection that is able to withstand the tensile forces that are present in the center tube 13 and end plug 20 during the clamping of the barrel 11 on the bat 55 that is regularly present after assembly of the barrel 11 on the bat 55.

FIG. 7E is a detailed view of a region 7E showing the hollow end cap 17 and the nut 19. In this figure the geometry of the hollow end cap 17 and the nut 19 are shown. Also shown more clearly is the interface between the inside diameter of the barrel 11 and the smooth flange on the hollow end cap 17. The hollow end cap 17, as shown in this embodiment of the invention, incorporates a smooth hole 73 which passes fully through the end cap 17 along the center axis 65 of the bat 55. This allows the threaded plug 20 to pass through and for the nut 19 to be attached to the threaded plug 20 to tighten the assembly together. In another embodiment of the hollow end cap 17, the center hole is threaded so that a separate nut 19 is not required. The hollow end cap 17 itself includes a dome shaped end, a counterbore 75 to the central hole 73 (if a nut 19 is used), and a smooth flange 77 that slides into and supports the barrel 11. Like on the transition 57 described above, this flange is slightly recessed to allow the end of the barrel 11 to squarely mate with a surface extending radially from a center of the end cap 17 and being normal to the axis 65 extending down the length of the central tube 13.

FIG. 7F is a sectional side view of an alternative embodiment of a threaded end plug 78, end cap 79, and nut 80. In this embodiment, the threaded portion is provided by a threaded shaft 82 that is inserted in a main body of the plug 78 and extends distally to receive the nut 80. Since the shaft 82 is smaller in diameter than the threaded portion of the threaded end plug 20, the hole through the end cap 79 can be smaller. Furthermore, because the shaft 82 is smaller in diameter than the threaded portion of plug 20, the shaft 82 may be made of a stronger and denser material such as stainless steel without a significant weight impact. Otherwise, the end cap 79, plug 78, and nut 80 assembly is substantially similar to that shown and described with regard to FIGS. 7A–7E above.

FIG. 8A is an exploded perspective view of a further embodiment of a bat 85 in accordance with the invention similar to the embodiments of FIGS. 7A–7F. However, instead of a threaded end plug 20, 79 and nut 19, 80 to hold the end cap in place, the end plug 20, 79 has been replaced by an end plug 86 having internal threads and the assembly nut 19, 80 has been replaced by a screw 88. The embodiment of FIG. 8A is otherwise substantially similar to that of FIGS. 7A–7F.

FIG. 8B is a sectional side view of a portion of the bat 85. The portion of the bat 85 shown in FIG. 8B differs from the embodiments of FIGS. 7A–7F. As shown, the end plug 86 receives the threaded screw 88. The head of the screw 88 holds a modified end cap 90 in place on the end of the center tube 13 and the barrel 11.

It should be noted that each of threaded sleeves or fittings 21, 22, nut 19, 80 or analogous screw 88, threaded end plugs 20, 79, internally threaded end plug 86, end caps 17, 78, 90 and transition pieces 12 and 59 are all couplers. Additional couplers may also be substituted for these elements without departing from the spirit and scope of the invention. However, the configuration of the couplers is considered to be unique and very advantageous.

In all of the embodiments, the couplers are located and configured to spread bending forces over large sections and along great lengths of the bats 5, 35, 55, and 85. In the embodiment of FIGS. 1–6B, this is accomplished by providing the couplings 20, 21, and 51 with bearing surfaces comprising female threads 27 and male threads 31 and 38 as shown in FIGS. 3B, 3C, and 6A. As can be appreciated, the bearing surfaces are at radii that are almost as great as the diameter of the barrel. As such, the sections over which the bending forces are spread during play are much greater than they would be if the bearing surfaces were at smaller radii. Furthermore, the strength of the material distributed at the larger radii is much greater. Still further, the bearing surfaces of the mating couplings 20, 21, and 51 extend a sufficient length in the axial directions to distribute the bending loads along a substantial length of the bats 5 and 35.

In the embodiments of FIGS. 7A–8B the bearing surfaces are relatively smooth surfaces comprising portions of smooth flange 61 and surfaces 63 on transitions 57, and analogous surfaces on each of the end caps 17, 77, and 90. These bearing surfaces abut bearing surfaces of the barrel 11 and apply clamping or compressive forces under the action of the center tube 13, end plugs 20, 79, 86, and the nuts 19, 80 or screw 88. The nuts 19, 80 or screws exert the tensile force when turned in a tightening direction. The nuts 19, 80 can have a hex or other configuration. The screw can incorporate a hex or other shaped depression in the head for conventional or other manipulation. The nuts, 19, 80 and screw 88 may be configured with a security or custom configuration that requires a special tool for tightening or loosening.

The center tube 13, end plugs 20, 79, 86, and nuts 19, 80 or screw 88 all exert tensile forces at much smaller radii than the barrel 11 and its bearing surfaces. These tensile forces act to hold the various components of the bats 55, 85 together in a clamped configuration. Significant bending forces are kept from affecting these components of smaller radii because of the strength of the barrel 11, end caps 17, 77, 90, and transition 57 and their geometries that spread the forces along the length of the center tube 13 during impact. Specifically, a force of impact applied generally radially on the barrel is transferred at least in part to the end caps 17, 77, 90 and transition which in turn transfer at least a portion of the force to the center tube 13. However, the force of impact that is transferred to the center tube 13 is transferred along an inner surface of the through hole of the end caps 17, 77, 90 and along the inner surface of the transition 57. This transfers bending forces that are not taken up by the barrel 11 and other components along a large area of the center tube and enables these bending forces to be taken up along substantially an entire length of the center tube. Thus stress concentrations are avoided and the tendency to failure due to these forces is reduced. Furthermore, the bat may be made more aesthetic by providing the Transition pieces with smooth outer surfaces as opposed to the ribbed surfaces shown in the Figures.

Still further, it is contemplated that alternative end plugs and caps could be substituted for greater security and safety against a piece such as a barrel from flying off a distal end of the bat during play. Such alternative plugs could have a disk shaped head integral with a shaft that is fixed in a distal end of a center tube similar to the embodiments described above. Such an integral disk structure would secure the end cap and barrel against distal movement. In this case the end cap and barrel would have to be installed from a proximal end of the center tube. Furthermore, the transition and barrel would have to be secured against movement in a proximal direction such as by threads between the transition piece and the center tube.

Another secure system of securing the barrel against distal movement may include redundancy of locking mechanisms.

For example, an end piece can be provided with an oblong opening for receiving an oblong head portion on an extension of an end plug. Thus, the head portion can be inserted through the oblong opening and turned ninety degrees. In this orientation, movement of the end cap in a distal direction is blocked since axes of the oblong opening and head portion are perpendicular to each other. To secure the end cap and the end plug in this orientation, an anti-rotation wedging mechanism is inserted on opposite sides of the oblong head portion and tightened with a pair screws.

One of the advantages of the present invention that is accomplished by all of the embodiments, to some degree, is that the bats 5, 35, 55, and 85 all incorporate components that are more easily manufactured than are the components of the bats of the past. Thus, the bats 5, 35, 55, and 85 can be made less expensively. Specifically, this is accomplished by forming one or more of the components having complex shapes that are difficult to machine from a plurality of components of shapes that are easily machined or easily molded. For example, the barrel 11 for all of the embodiments is a simple tubular component as opposed to the barrels of the past that transition into complex transition and butt end portions that require special machining. Similarly, the molded transitions 12, 57, and end caps 18, 17, 77, 79, and 90 are much more easily molded than machined as required in the past. Forming couplings 20, 21, and 51 by molding is also an easy manufacturing step, and adhesively bonding the couplings to their respective barrel and transition pieces is a further simple manufacturing step. The resulting advantage of providing a bat that can easily be dismantled and reconfigured is worth the additional manufacturing steps. Especially, since the components over all can be made for less than the components of bats of the past. Still further, the performance of the bats 5, 35, 55, and 85 is adjustable as set forth above.

Another aspect of the performance of the bats of the present invention is that the materials and configurations lend to a light weight bat. With most of the components formed of light weight composites as set forth above, the weight of the bats can easily be kept under 30 ounces. In fact, for most lengths of bats, it is possible to keep the weights in a range from 22 ounces to 30 ounces when incorporating the composite materials with an epoxy, thermoset, or thermoplastic matrix as set forth above. In particular, a polyurethane thermoset matrix material is beneficial in providing a strong light weight bond. Weight can be kept low by forming most or all of the larger components of the lighter weight composite components, while the smaller components such as end plugs and other couplers may be formed of denser materials such as aluminum or other materials.

As can be appreciated, a grip (not shown) will normally be provided on bats of all of the above described embodiments. Typically, this grip may be of any of a variety of relatively thin conventional materials and extend from the knob 16 distally a distance in the range from 10 inches to 15 inches.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, it is contemplated that many couplers and configurations of couplers could be provides in accordance with the above described principles without departing from the spirit and scope of the present invention.

What is claimed is:

1. A reconfigurable ball bat comprising:

a center tube having a first diameter and a first length extending between a proximal end and a distal end of the center tube;

a transition piece mounted on the center tube at a position spaced from the proximal end of the center tube, the transition piece having a bearing surface;

a barrel having a proximal end with a proximal bearing surface, the proximal bearing surface of the barrel solely in contact with the bearing surface of the transition piece; and a coupler at a distal end of the barrel, said coupler removably mounting the barrel on the transition piece, and said coupler being the only mechanism that positively inhibits axial movement of the barrel away from the transition piece.

2. A reconfigurable ball bat comprising:

a center tube having a first diameter and a first length extending between a proximal end and a distal end of the center tube;

a transition piece mounted on the center tube at a position spaced from the proximal end of the center tube, the transition piece having a bearing surface with a minimum diameter in a range from 2 to 3½ times the first diameter;

a barrel having a proximal end with a proximal bearing surface having a minimum diameter in the range from 2 to 3½ times the first diameter, the proximal bearing surface of the barrel solely in contact with the bearing surface of the transition piece; and a coupler at a distal end of the barrel said coupler removably mounting the barrel on the transition piece; wherein:

the coupler is one of a plurality of couplers;

the minimum diameter is one of a plurality of respective minimum diameters of said plurality of couplers; and the minimum diameter of each of the couplers is in a range from 2 to 3½ times the first diameter.

3. A reconfigurable ball bat kit comprising:

a center tube;

at least one transition piece, a plurality of barrels selectively connectable and separable from the center tube; wherein:

the plurality of barrels are selectively supported on the center tube by the transition piece;

the plurality of barrels have a variety of diameters;

the at least one transition piece is one of a plurality of transition pieces having barrel bearing surfaces of a corresponding variety of diameters for supporting the plurality of barrels; and the kit further comprising:

at least one knob; and at least one end cap.

4. The kit of claim 3, further comprising means for selectively and removably mounting and supporting the barrels on the center tube by the transition piece.

5. The kit of claim 3, further comprising:

an end plug for connecting to the center tube; and an assembly screw for clamping the barrel between the transition piece and the end cap.

6. The kit of claim 3, further comprising:

a tamper resistant element for connection to the barrel;

wherein the tamper resistant element inhibits tampering with an interior of the barrel without obvious modification to the tamper resistant element.

7. The kit of claim 3, further comprising structure on one or more of the center tube, transition piece, and the barrel enabling simple manipulation so that the kit can be assembled and disassembled quickly and easily in the field.

8. A method of using a reconfigurable ball bat, wherein the ball bat includes a center tube, at least one transition piece having an outer diameter increasing from a first diameter of the center tube to a second diameter, and a plurality of barrels, the method comprising:

selecting a barrel from among the barrels; and forming a tapered transition from the center tube to the barrel by supporting the barrel on the transition piece generally at the second diameter.

9. A reconfigurable ball bat in a range of standard sizes comprising:

a center tube including a handle portion;

a barrel section removably connected to the handle portion and receiving the center tube therethrough;

a butt end supported on the barrel;

a knob supported on the handle portion; wherein:

the handle portion, barrel section, butt end, and knob form a bat of length within the range of standard sizes;

the reconfigurable ball bat weighs less than or equal to 30 ounces; and the bat has a transition forming a relatively smooth continuous surface including at least portions of the barrel section and the handle portion.

10. The reconfigurable ball bat of claim 9 wherein the bat weighs less than or equal to 28 ounces.

11. The reconfigurable ball bat of claim 9, wherein the bat weighs less than or equal to 26 ounces.

12. The reconfigurable ball bat of claim 9, wherein the bat has a weight in a range from 22 ounces to 24 ounces.

13. The reconfigurable ball bat of claim 9, wherein the bat has a weight in ounces equal to a length in inches minus at least three.

14. The reconfigurable ball bat of claim 9, wherein at least one of the handle portion, barrel section, and butt end is removably connected to the rest of the bat so that the bat can be easily and quickly taken apart for inspection and put back together on the field.

15. A reconfigurable ball bat kit comprising:

a center tube;

at least one transition piece, at least one barrel wherein the barrel is selectively connectable and separable from the center tube; and a tamper resistant element connected to and enclosing an interior of the barrel;

wherein the tamper resistant element inhibits access to an interior of the barrel without obvious modification to the tamper resistant element.

* * * * *